United States Patent [19]

Schörnig

[11] 4,003,500

[45] Jan. 18, 1977

[54] METERING DEVICE

[75] Inventor: Eberhard Schörnig, Bleidenstadt, Germany

[73] Assignee: Hoechst Aktiengesellschaft, Germany

[22] Filed: Apr. 18, 1975

[21] Appl. No.: 569,500

Related U.S. Application Data

[63] Continuation of Ser. No. 213,041, Dec. 28, 1971, abandoned.

[30] Foreign Application Priority Data

Dec. 31, 1970 Germany ..... 2064709

[52] U.S. Cl. ..... 222/133; 222/194; 222/288; 222/DIG. 1

[51] Int. Cl.[2] ..... B67D 5/56

[58] Field of Search ..... 222/56, 370, 194, 133, 222/DIG. 1; 214/17 CC

[56] References Cited

UNITED STATES PATENTS

| | | | |
|---|---|---|---|
| 31,530 | 2/1861 | Cluxton | 222/370 X |
| 2,034,964 | 3/1936 | Thompson | 222/56 X |
| 2,529,654 | 11/1950 | Gilmore et al. | 222/305 |
| 2,616,606 | 11/1952 | Beehler | 141/144 |
| 2,680,683 | 6/1954 | Obenshain | 222/194 X |
| 2,730,285 | 11/1956 | Lazzery | 222/288 X |
| 2,767,889 | 10/1956 | Manrose | 222/284 |
| 3,180,313 | 4/1965 | Eisner | 222/361 X |
| 3,195,776 | 7/1965 | Helm et al. | 222/370 X |
| 3,251,511 | 5/1966 | Lloyd | 222/370 |
| 3,260,408 | 7/1966 | Smitzer | 222/1 |
| 3,554,406 | 1/1971 | Kleysteuber | 222/370 X |
| 3,603,289 | 9/1971 | Masua | 118/23 |

*Primary Examiner*—Allen N. Knowles
*Assistant Examiner*—Hadd S. Lane
*Attorney, Agent, or Firm*—James E. Bryan

[57] ABSTRACT

This invention relates to a metering device for use in a developing apparatus operating on the electrostatic imaging principle, which comprises a plurality of chamber means movable into a developer cycle, and means for filling said chamber means with a developer liquid comprising a high resistance liquid phase and a fine-grained solid phase.

5 Claims, 5 Drawing Figures

INVENTOR

EBERHARD SCHÖRNIG

James E. Bryan

ATTORNEY

Figure 2:
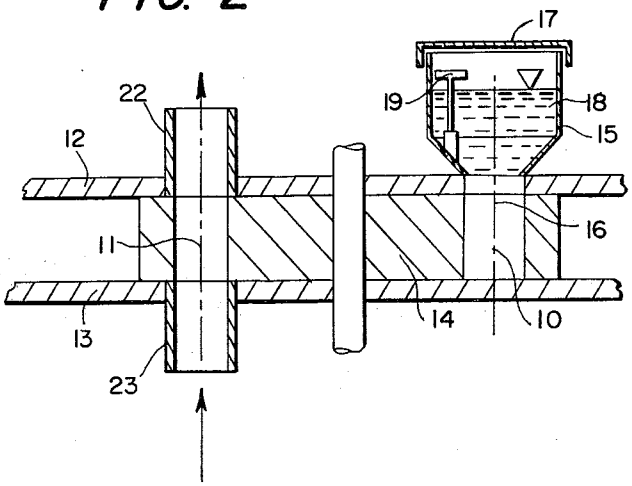

INVENTOR
EBERHARD SCHÖRNIG

James E. Bryan
ATTORNEY

METERING DEVICE

This is a continuation of application Ser. No. 213,041, filed Dec. 28, 1971, now abandoned.

This invention relates to a developing apparatus for use in a copier operating according to the electrostatic imaging principle, in which a developer liquid is circulated, by pumping, which consists of a high-resistance liquid phase and a fine-grained solid phase dispersed therein, of which latter the developer is depleted during operation.

Developing systems of this type are known. For supplying the solids concentrate, and especially for re-filling, small storage containers are used with such systems, which are manually shaken for homogenization before filling the mixture into the machine. Further, it is known to achieve uniform development by replacing the developer tank together with the developer depleted of the solid phase, i.e. by using so-called disposable containers.

Filling-in from storage containers has proved to be difficult. Prior to each filling, the concentrate must be homogenized, which can be achieved only by thoroughly shaking or stirring it. If less care is taken, undesirable changes in concentration may easily result from larger particles adhering to the bottom and the walls of the container. Normally, the requirement for re-filling occurs during operation of the machine, so that longer interruptions, which are necessary for careful homogenization, cannot be tolerated.

When the copying machine operates to meet relatively high demands, replenishing will be necessary more frequently, which means that more work and more time are required. In addition to these drawbacks, it is relatively difficult to handle the strongly colored solids concentrate. The exchange of developer tanks has proved to be uneconomical, especially when much work must be done or originals of large size are to be copied, because large quantities of unusable liquids result whose disposal is problematic.

Moreover, homogenization of the liquid in replaceable tanks is difficult because during storage relatively firm layers are formed which are differentiated according to the different grain sizes deposited.

The present invention provides a developing apparatus of the type described, which avoids the above-mentioned drawbacks and ensures a constant, flawless supply of fine-grained solids of uniform particle size distribution, in particular also in the case of a solid phase with a strong sedimentation tendency.

For solving the problem of the present invention, a developing apparatus for use in a copier operating by the electrostatic imaging principle is used as a basis, in which a developer liquid is circulated by pumping, which consists of a high-resistance liquid phase and a fine-grained solid phase dispersed therein, of which latter the developer is depleted during operation. The apparatus according to the invention contains a metering device comprising chambers which can be moved into the developer cycle and are filled with a solids concentrate by means of a filling device.

By distributing the homogenized solids concentrate upon the chambers, it is guaranteed that each filling contains solids of the same particle size distribution.

The chambers are formed by bores in rotatable discs or sliding bars and thus are arranged either on a circular path or a straight path. In a preferred embodiment of the invention, the chambers are bores in a rotatable disc, the front ends of which are sealed by fixed plates in connection with suitable sealing means, such as TEFLON rings.

The volume of the chambers may be adjusted to any desired size by inserting exchangeable bushings.

The metering device according to the invention may be used for any type of sedimenting mixture of solids and liquids. It is of particular advantage, however, in the case of strong sedimentation, i.e. for solids having a density of more than 1.2 g/cm$^3$, preferably of more than 2 g/cm$^3$.

According to the invention, as much homogenized solids concentrate is filled into the filling device as corresponds to the total volume of all chambers taken together. This measure ensures that even in the case of strong sedimentation of the concentrate in the chambers, a uniform particle size distribution is always guaranteed.

An additional rinsing of the chambers, which may result in deviations of the concentration of the developer liquid, is no longer necessary, because the chambers are constantly cleaned by being swiveled into the developer cycle.

The device according to the invention can be used not only for replenishing the solids concentrate, but is also suitable for the initial introduction of the solid substance into the apparatus. In this case, it is not only the contents of one chamber which is introduced at one time, but an appropriate number of chamber fillings are added to the original, clean liquid phase, until the desired concentration of the developer liquid has been achieved.

Metering by means of the volumes of individual chambers takes very little time, is clean and accurate, and does not interfere with the developing process, because no homogenization is required when individual fillings are added, and the mixture is homogenized only before it is filled into the chambers.

By watching the copies issuing from the copying machine, it can be determined when it is necessary to replenish the solids concentrate of the developer liquid, and it is left to the experience of the operator to decide when and in which quantities the solids concentrate is to be added. The concentrate is then added by means of a control actuated by a push-button.

Figure 3:
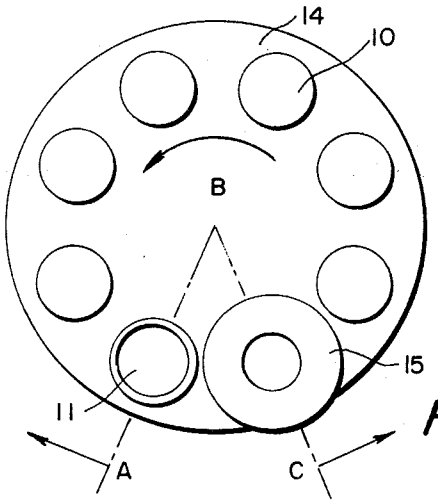
Figure 4:
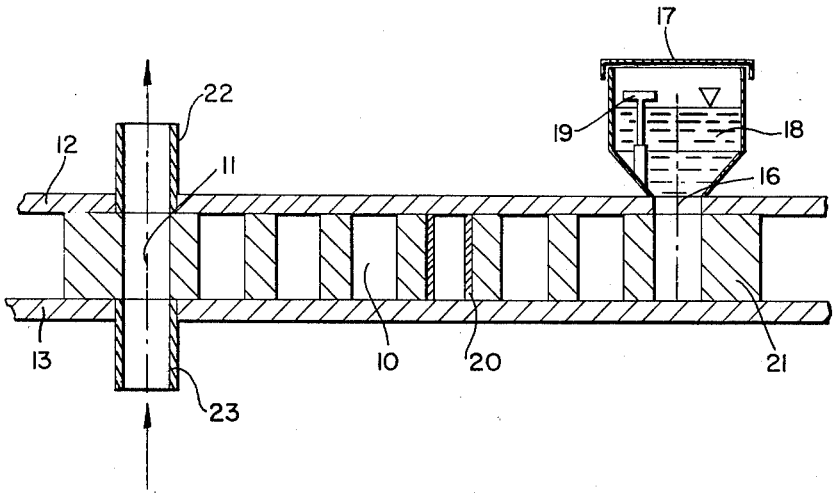
Figure 5:
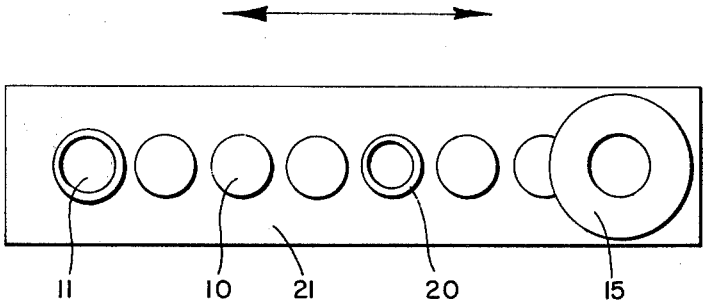

The invention will be described more in detail by reference to the accompanying drawings. In the drawings, FIG. 1 is a diagrammatic representation of a developing apparatus according to the invention in which a liquid is circulated, FIGS. 2 and 3 show a rotatable disc provided with chambers, as a top view and in section, and FIGS. 4 and 5 show, respectively, a plan view and a section of a linear embodiment of the present invention.

Figure 1:
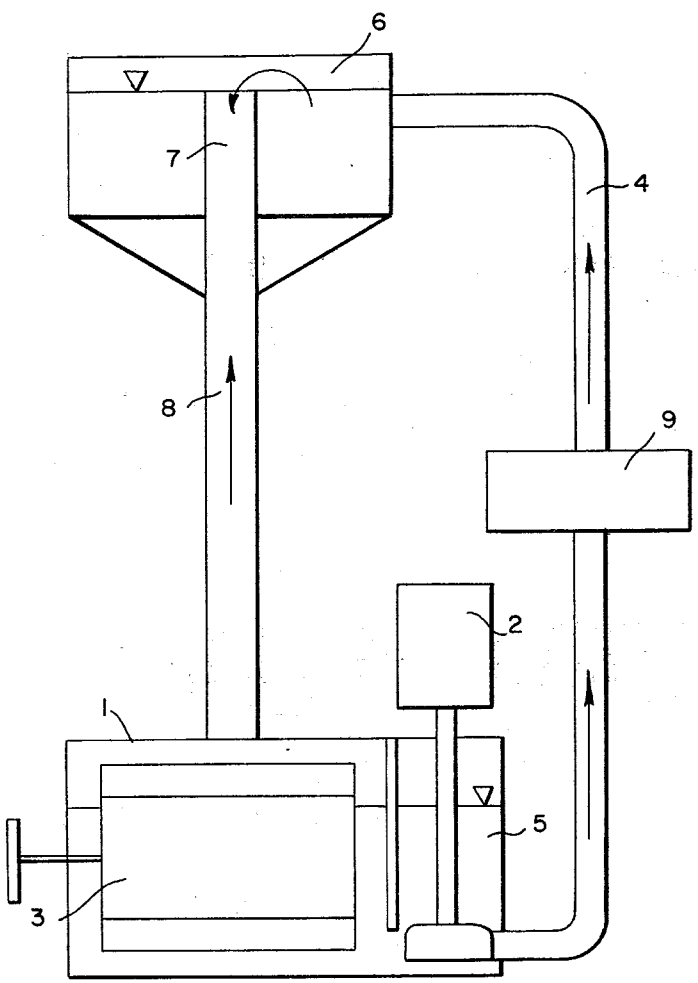

The developing apparatus according to FIG. 1 comprises a developer storage tank 1 with a pump 2 and a stirrer 3. The developer liquid 5 is pumped through the supply pipe 4 into the developer bath 6 and from there is returned through the overflow 7 and the return pipe 8 to the developer storage tank 1. The metering device 9 is fitted into the supply pipe 4. As can be seen from FIGS. 2 and 3, it comprises cylindrical chambers 10 which are closed at their front ends by fixed plates 12 and 13 provided with appropriate sealing means of a material which is not attacked by the developer liquid.

The metering device 9 shown in FIG. 1 is of such construction that one chamber 11 remains unfilled and maintains the circulation of the liquid, together with the openings 22 and 23 in the plates 12 and 13. As shown in FIGS. 4 and 5, the chambers 10 may be arranged in a linear arrangement on a bar 21 and moved by sliding, but preferably they are arranged in a circle on a swiveling disc 14 (see FIGS. 2 and 3) and are removed by swiveling or rotation. The chambers 10 are filled by means of a filling device 15 which is firmly attached to the plate 12 and has a filling hole 16. The filling device 15 may be closed by a lid 17. Independently of the quantity required in the developing apparatus, the solids concentrate 18 is carefully homogenized before it is filled into the filling device 15. The quantity of homogenized solids concentrate filled into the filling device 18 is controlled by means of the filling level marker 19. In principle, it corresponds to the total volume of the chambers 10 to be filled.

It was found to be advantageous to make the volume of the chambers 10 variable, so that the metering device 9 of FIG. 1 may be used for initial filling as well as for re-filling. The volume is varied by inserting exchangeable bushings 20 (FIGS. 4 and 5). Advantageously, the filling device 15 is provided with appropriate filling level markers 19.

The use of bushings in the metering device has the further advantage of making it possible to use metering devices of uniform construction in developing apparatuses of different sizes, without having to change the dimensions of the chambers.

Although FIGS. 3 and 5 show eight chambers 10 each, the number of chambers is not critical. Normally, it is determined by the space available and the diameter of the chambers.

With an embodiment of the apparatus in which the disc 14 carries eight chambers 10, the volume of 5 chambers was used for initial filling, and the volume of 7 chambers for refilling, when necessary, which means that the disc 14 was rotated through more than 360°.

The movement of the filled chambers into the developer cycle is caused by pressing a button which actuates a cam gear, the selection of an individual chamber or of several chambers one after the other being ensured in this manner. The completion depletion of all chambers on the disc is indicated by a control lamp.

It will be obvious to those skilled in the art that many modifications may be made within the scope of the present invention without departing from the spirit thereof, and the invention includes all such modifications.

What is claimed is:

1. A developing apparatus for use in a copier operating on the electrostatic imaging principle, which apparatus comprises means defining a developer flow path including pump means for circulating, around the path, a developer fluid composed of a high-resistance liquid phase with a finely-divided solid toner phase dispersed therein, of which solid toner phase the developer fluid is depleted during operation, metering means comprising a plurality of chambers for containing a solids toner concentrate for replenishing the developer, means whereby in a fluid-tight manner each chamber can be consecutively introduced, when desired, as a section of said path, thereby entering the contents of any introduced chamber into a developer fluid, and filling means mounted above the metering means for filling said chambers with said solids toner concentrate.

2. An apparatus as claimed in claim 1, in which each chamber is formed from a borehole in a disc adapted to be rotated in a fluid-tight manner between said filling means for said chamber and a station in which said chamber forms a section of said developer flow path.

3. An apparatus as claimed in claim 1, in which each chamber is formed from a borehole in a bar adapted to be moved longitudinally in a fluid-tight manner between said filling means for said chamber and a station in which said chamber forms a section of said developer fluid path.

4. An apparatus as claimed in claim 1, in which the said filling means is dimensioned to hold at least sufficient solids toner concentrate to fill all of the chambers.

5. An apparatus as claimed in claim 1, including, for any chamber, an interchangeable bushing means for insertion into the chamber to vary the volume thereof.

* * * * *